US006278932B1

(12) United States Patent
Bäumel et al.

(10) Patent No.: US 6,278,932 B1
(45) Date of Patent: Aug. 21, 2001

(54) METHOD FOR CONTROLLING AN INTERNAL COMBUSTION ENGINE

(75) Inventors: Hermann Bäumel, Newmarkt; Gunther Breu; Günther Alberter, both of Nürnberg; Werner Flierl, deceased, late of Sulzbach-Rosenberg, by Barbara Flierl, heir; Matthias Gramann, Neunkirchen; Gerhard Hettich, Dietenhofen; Werner Wiedemann, Herzogenaurach; Wolfgang Thiel, Denkendorf, all of (DE)

(73) Assignees: Temic Telefunken microelectronic GmbH, Heilbronn; DaimlerChrysler AG, Stuttgart, both of (DE)

( * ) Notice: Subject to any disclaimer, the term of this patent is extended or adjusted under 35 U.S.C. 154(b) by 0 days.

(21) Appl. No.: 09/367,673

(22) PCT Filed: Dec. 9, 1998

(86) PCT No.: PCT/EP98/07987

§ 371 Date: Apr. 20, 2000

§ 102(e) Date: Apr. 20, 2000

(87) PCT Pub. No.: WO99/32764

PCT Pub. Date: Jul. 1, 1999

(30) Foreign Application Priority Data

Dec. 18, 1997 (DE) ..... 197 56 342

(51) Int. Cl.[7] ..... F02D 41/04

(52) U.S. Cl. ..... 701/104; 701/107

(58) Field of Search ..... 701/101, 102, 701/103, 104, 105, 107, 115

(56) References Cited

U.S. PATENT DOCUMENTS

| | | | | |
|---|---|---|---|---|
| 4,730,256 | * | 3/1988 | Niimi et al. | 701/115 |
| 4,933,862 | * | 6/1990 | Wataya | 701/105 |
| 5,107,432 | * | 4/1992 | Martinelli | 701/103 |
| 5,444,626 | | 8/1995 | Schenk . | |
| 5,775,296 | * | 7/1998 | Giras et al. | 701/105 |
| 5,826,211 | * | 10/1998 | Kobayashi | 701/102 |
| 6,115,665 | * | 9/2000 | Rosner et al. | 701/102 |

FOREIGN PATENT DOCUMENTS

| | | |
|---|---|---|
| 3247916A1 | 6/1984 | (DE) . |
| 3524025A1 | 1/1987 | (DE) . |
| 0867602A1 | 9/1998 | (EP) . |
| 2616481 | 12/1988 | (FR) . |

* cited by examiner

*Primary Examiner*—Willis R. Wolfe
(74) *Attorney, Agent, or Firm*—Venable; Norman N. Kunitz

(57) ABSTRACT

A method for controlling an internal combustion engine with the aid of an engine control unit, having actuators for the electromagnetic valve control, as well as additional actuators, wherein each cylinder head has a separate actuator control unit, which is connected via a data bus to the engine control unit.

20 Claims, 1 Drawing Sheet

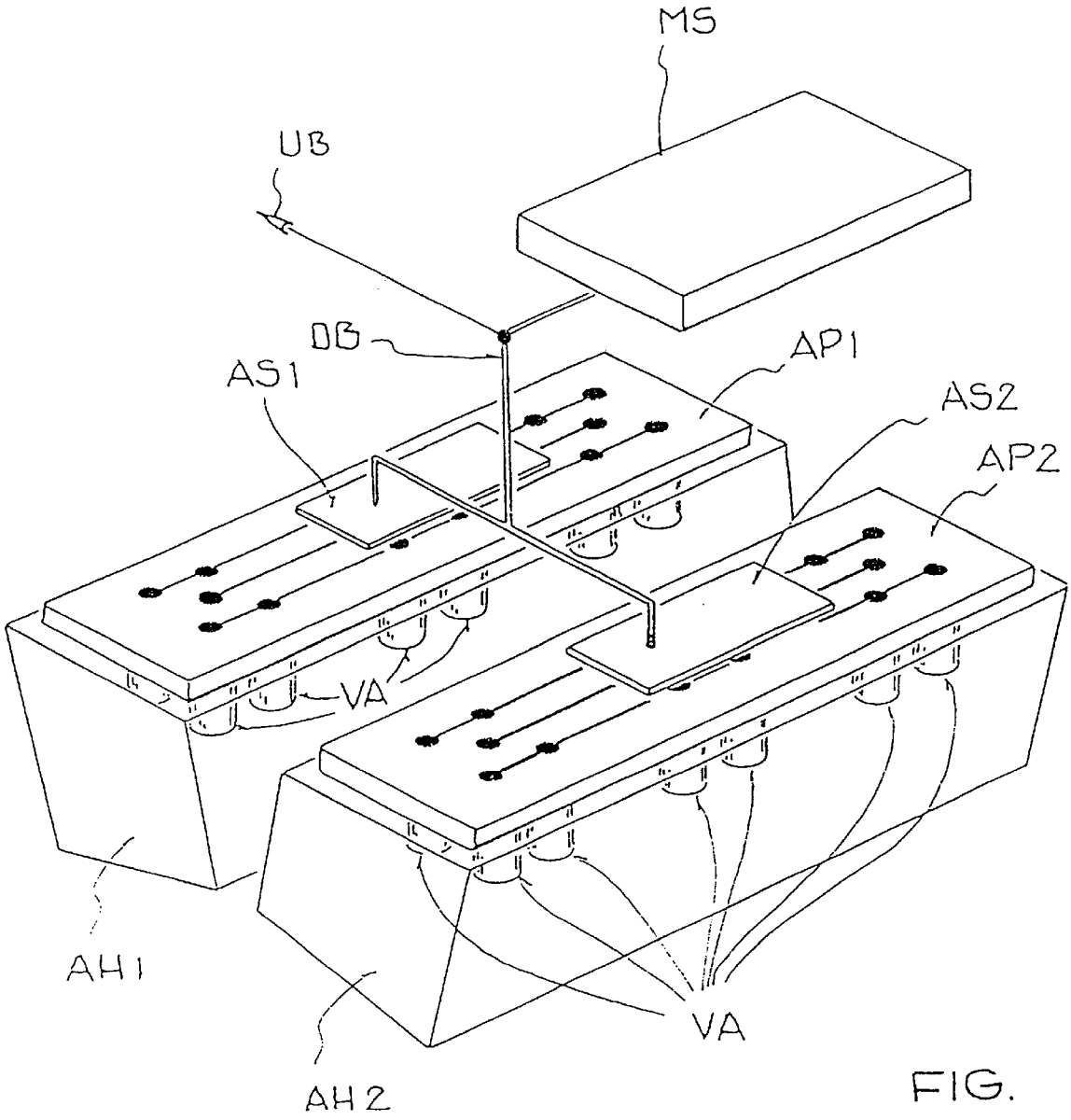
FIG.

METHOD FOR CONTROLLING AN INTERNAL COMBUSTION ENGINE

BACKGROUND OF THE INVENTION

The invention relates to a method for controlling an internal combustion engine, having at least two cylinder heads, one engine control unit and actuators for the electromagnetic valve control.

The actuators for the electromagnetic valve control, which are designed to form a separate component, essentially comprise an opening magnet and a closing magnet that are connected to each other by at least one housing part. The opening magnet and the closing magnet are electromagnets that respectively consist of one coil and one yoke. An armature plate made of a ferromagnetic material is located between the opening magnet and the closing magnet. By supplying current to the coil for the opening magnet or the coil for the closing magnet, the armature plate is moved in the respective direction. The opening magnet has a through opening for a push rod, which connects the armature plate with an actuator spring plate. An actuator spring is arranged between the actuator spring plate and the housing part or the outside of the housing magnet. Together with a gas shuttle valve, an actuator for the electromagnetic valve control forms a functional unit, wherein the gas shuttle valve is pulled into the valve seat of the cylinder head by means of a valve spring and a valve spring plate, corresponding to a conventional cylinder head with camshafts.

If a functional unit consisting of an actuator and a gas shuttle valve is mounted on the internal combustion engine, the actuator spring plate and the valve spring plate are pushed against each other. In the resting position of the functional unit, the armature plate is positioned exactly in the center between the opening magnet and the closing magnet. The gas shuttle valve in that case is in the center position between the valve seat for the cylinder head where the valve is closed and the maximum opened position for the valve.

The actuators for the electromagnetic valve control are advantageously operated in a device where the actuators are arranged inside the actuator wells of an actuator support and where the actuator support is screwed onto the cylinder head of the internal combustion engine. A cooled intermediate plane covers the actuator support. The cooled intermediate plane is provided with through openings for the connections of a pressed screen. The pressed screen is embedded in a multifunctional, injection-molded plastic part with thereon arranged actuator control unit, which is connected to the pressed screen. A covering that surrounds the actuator control unit covers the cooled intermediate plane. The actuator control unit is connected to an engine control unit that is arranged outside of the covering.

It is the object of the invention to provide a method for controlling an internal combustion engine with at least two cylinder heads, one engine control unit, and actuators, for electromagnetic value control. This method describes the connection between the actuator control unit and the engine control units and is also suitable for use with internal combustion engines having a plurality of cylinder heads.

SUMMARY OF THE INVENTION

The above object generally is achieved according to the invention by a method of controlling an internal combustion engine of the type mentioned above, wherein each cylinder head of the internal combustion engine has a separate actuator control unit for controlling the actuators for the electromagnetic valve control, which are connected via data bus to the engine control unit. A CAN data bus is preferably used as data bus.

Besides the actuators for the electromagnetic valve control, each cylinder head of the internal combustion engine is provided for this with additional actuators, which are also controlled by the actuator control unit for the cylinder head.

The engine control unit in particular controls those internal combustion engine functions which are based on the interplay of the various components of the internal combustion engine, e.g., the fuel injection, the operating cycle of the valves and the ignition sequence. In addition, a speed regulation system, the load detection and a Lambda regulation can be integrated into the engine control unit. The engine control unit also takes on diagnostic functions of the internal combustion engine.

The actuator control units assume the control of the individual function sequences for the actuators for the electromagnetic valve control, as well as the additional actuators. The control can consist of simple start-up and shutdown functions of the actuators or complex regulating processes, which are realized in dependence on sensor data and/or performance characteristics.

The actuator control units control the actuators for the electromagnetic valve control, as well as the additional actuators, with the aid of values that are preset by the engine control unit. For example, the respective actuator control unit regulates the current intensity with which the actuators for the electromagnetic valve control are actuated in order to open and close the valves. The engine control unit predetermines the times when the gas shuttle valves are opened or closed by the actuators for the electromagnetic valve control, so as to ensure the correct operating cycle of the valves for the internal combustion engine.

According to a modification of the invention, the engine control unit is integrated into one of the actuator control units.

Another modification of the invention provides that the sensors for the internal combustion engine, which detect the sensor data necessary for controlling the internal combustion engine, are directly connected to the engine control unit. Insofar as it is necessary, sensor data are transmitted via the data bus from the engine control unit to the actuator control units.

According to one advantageous modification of the invention, the data bus is designed in such a way that one actuator control unit can also obtain the sensor data from another actuator control unit.

In yet another modification of the invention, it is provided that the actuator control units have emergency running properties, which make it possible to continue the internal combustion engine operation, at least for a short period of time, following the occurrence of malfunctions.

In order to provide these emergency running properties, the actuator control units are not only connected via the data bus and the engine control unit to the engine sensors, but are also connected directly to engine sensors for the internal combustion engine, preferably to the sensors for determining the crankshaft speed and the crankshaft angle of rotation.

A modification of the invention furthermore provides for synchronizing the sensor data made available to the actuator control units via the data bus and the direct connection to the engine sensors.

If at least one actuator for the electromagnetic valve control fails, the coordinated actuator control unit will shut off the fuel supply to the affected cylinder, in keeping with the emergency running properties.

Should the connection between one actuator control unit and the engine control unit fail, the affected actuator control unit itself takes over control of the actuators for the electromagnetic valve control and the additional actuators in keeping with the emergency running properties. The values preset by the engine control unit for controlling the functions of the actuators for the electromagnetic valve control and the additional actuators are taken from performance characteristics, which are stored at least speed-dependent in the actuator control units. The performance characteristics relate, for example, to the ignition control, the fuel injection control and the control of the operating cycle for the valves.

In the following, the method according to the invention for controlling an internal combustion engine with at least two cylinder heads is explained and demonstrated with the aid of an exemplary embodiment for a six-cylinder internal combustion engine with two cylinder heads and in connection with a Figure.

BRIEF DESCRIPTION OF THE DRAWINGS

The FIGURE is a schematic representation of the connection between the engine control unit and two actuator control units by means of a data bus.

DETAILED DESCRIPTION OF THE PREFERRED EMBODIMENT

For an Otto engine with six cylinders, used in a passenger vehicle (PKW), the cylinders are arranged in a V shape for a compact design of the Otto engine. As a result, two cylinder heads for respectively three cylinders are arranged on the engine block of the Otto engine. With the four-valve design for the cylinder heads, a valve actuator VA is used for the electromagnetic valve control of each gas shuttle valve. Respectively one actuator holder AH1, AH2 is arranged form-fittingly on the cylinder heads of the Otto engine. The actuator holders AH1, AH2 comprise respectively twelve actuator wells for three cylinders to accommodate the valve actuators VA. The actuator wells are arranged in groups of four in the actuator holders AH1, AH2 around a respective spark plug well.

The valve actuators VA are designed to form a pre-assembled component, comprising an opening magnet with a through opening and a closing magnet, which are connected to each other by a housing part. The opening magnet and the closing magnet are electromagnets and respectively consist of a yoke and a coil. An armature plate of a ferromagnetic material is arranged between the two magnets. The armature plate is connected via a push rod to an actuator spring plate. The push rod in this case is guided through the opening in the opening magnet. An actuator spring arranged between the actuator spring plate and the opening magnet effects the resetting of the amature plate after it has been attracted by the closing magnet. The electrical connections for both electromagnet coils of an actuator for the electromagnetic valve control project from the side of the housing part and are combined to form a connecting device.

Together with a gas shuttle valve, the valve actuator VA forms a functional unit. The gas shuttle valves are pulled into the valve seat of the cylinder head by respectively one valve spring and via a valve spring plate that is attached to the valve shaft. In the resting position of a functional unit, comprising a gas shuttle valve and a valve actuator, the actuator spring plate and the valve spring plate are pushed against each other. The armature plate is therefore located exactly in the center position between the opening magnet and the closing magnet. The valve spring effects the resetting of the amature plate into this center position after the armature plate was attracted by the opening magnet in order to open the gas shuttle valve.

The actuator holders AH1, AH2, with actuator wells into which the valve actuators VA are inserted, are respectively located at an angle to the base surface of the actuator holders AH1, AH2, thereby allowing the push rod of a valve actuator element VA to form a straight line with the valve shaft of a gas shuttle valve. The connecting devices for the valve actuators VA in that case are positioned perpendicular to the surface of the actuator holders AH1, AH2.

A separate cooled intermediate plate is arranged on each of the two actuator holders AH1, AH2 with valve actuators VA and is realized as aluminum plate AP1, AP2. The aluminum plates AP1, AP2 contain cooling water ducts, which are connected to cooling water ducts for the actuator holders AH1, AH2. In addition, the aluminum plates AP1, AP2 contain openings through which the connecting device for the valve actuators VA is connected to the pressed screen connections of a pressed screen. The pressed screens are respectively embedded in a multifunctional, injection-molded plastic part and represent the connection between the valve actuators VA of a cylinder head and the associated actuator control unit AS1, AS2.

The aluminum plates AP1, AP2, the multifunctional plastic part and an actuator control unit AS1, AS2 are respectively enclosed by one covering. The coverings are made of plastic and carry the design of the passenger vehicle manufacturer. The coverings respectively have an interface for connecting the actuator control units AS1, AS2 by means of a CAN data bus DB with an engine control unit MS with engine sensors S, as well as with the current supply UB for the Otto engine. The CAN (controller area network) data bus DB is used for the high-speed data transfer and is developed especially for use in motor vehicles.

The arrangement of the engine control unit MS and the two actuator control units AS1, AS2 of the six-cylinder Otto engine with electromagnetic valve control is shown schematically in the Figure. The complete data exchange between the actuator control units AS1, AS2 and the engine control unit MS takes place via the CAN data bus DB.

The engine control unit MS preferably regulates or controls the sequence of system functions that are based on the correct interplay of identical components (six in part for the six-cylinder engine) or on the cooperation of different components (injection - ignition) of the Otto engine. These system functions include, for example, the ignition sequence, the operating cycle of the valves and the fuel injection.

The engine control unit MS is connected to a plurality of engine sensors S to manage these system functions. The most important of these are the sensors for detecting the crankshaft speed and the crankshaft angle of rotation.

The actuator control units AS1, AS2 control or regulate the basic functions of the actuators, which are assigned to the respective cylinder head. These basic functions are carried out by the actuator control units AS1, AS2, based on values preset by the engine control unit MS, and concern the valve actuators VA, as well as other actuators, e.g., the magnetic valves for the fuel injection and the spark plugs.

For the operating cycle of the valves in the Otto engine, the valve actuators VA for the electromagnetic valve control are controlled by the actuator control units AS1, AS2, based on preset values from the engine control unit MS. The values preset by the engine control unit MS concern the points in time at which the opening magnets and the closing magnets for the twenty-four valve actuators VA actuate the intake valves and the discharge valves of the six cylinders for the Otto engine. The engine control unit MS determines the optimum points in time in dependence on the crankshaft speed and the crankshaft angle of rotation, the load condition and the engine temperature.

For each valve actuator VA, the actuator control units AS1, AS2 regulate the current intensity that is necessary for a gas shuttle valve to be opened counter to the combustion chamber pressure, for example, or to be pulled into the valve seat of the cylinder head at a speed of 0 $^{m}/_{s}$ if possible. For this regulation, a device is mounted in each valve actuator VA, which can be used to determine in the valve actuator VA the exact position of the armature between the opening magnet and the closing magnet.

For the fuel injection of the Otto engine, magnetic valves that are arranged between the fuel pump and the fuel injectors and function to suppress the fuel injection are also actuated by the actuation element control units AS1, AS2 based on preset values from the engine control unit MS. The engine control unit MS determines the start and the duration of the fuel injection. The actuator control units AS1, AS2 regulate the course of the injection or a possible injection before or after the normal injection. The actuator control units AS1, AS2 monitor the error-free function of the magnetic valves with the aid of the current course.

The ignition device of the Otto engine is designed as an alternating current ignition and is combined with a device for determining the ion current. For the correct ignition sequence, the actuator control units AS1, AS2 are instructed by the engine control unit MS as to which spark plug of the six-cylinder Otto engine is to be ignited next.

The spark plug ignition is triggered by the respective actuator control unit AS1, AS2. In the process, the ion-current signal from the actuator control unit AS1, AS2 is used to displace the ignition moment as close as possible toward OT and to detect a possible knocking signal. In addition, the actuator control units AS1, AS2 control the ignition spark intensity in dependence on the speed. The necessary information concerning the crankshaft speed and the crankshaft angle of rotation is provided by the engine control unit MS to the actuator control units AS1, AS2 via the data bus DB.

In case misfirings are detected through the ion-current measuring on a cylinder, the magnetic valves are blocked by the corresponding actuator control unit AS1, AS2 and the supply of fuel for this cylinder is shut off to protect a catalytic converter.

The engine control unit MS takes on other functions such as the load detection or the Lambda regulation. In addition, special functions involving a speed control device and the limiting of the rotational speed are integrated into the engine control unit MS. Furthermore, the engine control unit MS also takes on the diagnostic functions.

The engine control unit MS and the actuator control units AS1, AS2 are provided with special emergency running properties to handle the failure of individual components of the Otto engine. This is designed to allow a continued operation of the Otto engine, at least for a short period of time, or to protect motor vehicle components such as the catalytic converter against damage.

If a valve actuator VA for the electromagnetic valve control fails, the injection of fuel into the three cylinders of the affected cylinder head is stopped in keeping with the emergency running properties. The motor vehicle is then operated with three cylinders only. The engine control unit MS is provided in that case with special ignition performance characteristics.

The actuator control units AS1, AS2 are provided with independent performance characteristics for the operating cycle of the valves, the fuel injection and the ignition if the data transmission between the engine control unit MS and the actuator control units AS1, AS2 fails. For this, the data transmission between the actuator control units AS1, AS2 must be functional. In addition, the actuator control units AS1, AS2 also have a connection to the sensors for detecting the crankshaft speed and the crankshaft angle of rotation, which is independent of the CAN data bus DB. During the normal Otto engine operation, the signals from the sensors for detecting the crankshaft speed and the crankshaft angle of rotation, which are transmitted to the engine control unit MS and the actuator control units AS1, AS2, are compared and synchronized.

The above-described allocating of the system functions to the engine control unit MS and of the basic functions to the actuator control units AS1, AS2 permits a reliable operation of the otto engine, wherein the actuating control units AS1, AS2 are advantageously close to the actuators they control and the rapid transmission of instructions from the engine control unit to the actuator control units AS1, AS2 is ensured through the data bus DB.

What is claimed is:

1. A method for controlling an internal combustion engine having at least two cylinder heads, one engine control unit (MS) and actuators for the electromagnetic valve control (VA), characterized in that a separate actuator control unit (AS1, AS2) for controlling the actuators of the electromagnetic valve control (VA) is assigned to each cylinder head of the internal combustion engine and that the actuator control units (AS1, AS2) are connected to the engine control unit (MS) via a data bus (DB).

2. A method according to claim 1, characterized in that in addition to the actuators for the electromagnetic valve control (VA), each cylinder head for the internal combustion engine has additional actuators, which are controlled by the actuator control unit (AS1, AS2) of the cylinder head.

3. A method according to the claim 2, characterized in that the engine control unit (MS) in particular controls the interplay between the individual components for the internal combustion engine.

4. A method according to claim 1, characterized in that the actuator control units (AS1, AS2) control the functions of the actuators for the electromagnetic valve control (VA) and the functions of the additional actuators.

5. A method according to claim 1, characterized in that the engine control unit (MS) provides preset values to the actuator control units (AS1, AS2) for controlling the functions of the actuators for the electromagnetic valve control (VA) and the functions of the additional actuators.

6. A method according to claim 1, characterized in that the engine control unit (MS) is integrated into one of the actuator control units (AS 1, AS2).

7. A method according to claim 1, characterized in that a CAN bus is used as the data bus (DB).

8. A method according to claim 1, characterized in that the engine sensors (S) for the internal combustion engine are connected to the engine control unit (MS) and that sensor data are transmitted by the engine control unit (MS) via the data bus (DB) to the actuator control units (AS1, AS2).

9. A method according to claim 8, characterized in that an actuator control unit (AS1; AS2) can obtain the sensor data from the engine control unit (MS) or from another actuator control unit (AS1; AS2).

10. A method according to claim 1, characterized in that emergency running properties are assigned to the actuator control units (AS1, AS2), which make it possible to continue to operate the internal combustion engine for a short period of time after malfunctions occur.

11. A method according to claim 10, characterized in that the engine sensors (S) of the internal combustion engine are also connected directly to the actuator control units (AS1, AS2) in order to provide the emergency running properties.

12. A method according to claim 1, characterized in that sensor data made available to an actuator control unit (AS1, AS2) via the data bus (DB) and via a direct connection to the engine sensors (S) are synchronized.

13. A method according to claim 1, characterized in that if at least one actuator for the electromagnetic valve control fails, the fuel supply to the affected cylinder is suppressed with the aid of the associated actuator control unit (AS1, AS2).

14. A method according to claim 1, characterized in that if the connection between an actuator control unit (AS1, AS2) and the engine control unit (MS) fails, the preset values of the engine control unit (MS) for controlling the functions of the actuators for the electromagnetic valve control (VA) as well as the other actuators of the corresponding cylinder head are obtained by the actuator control unit (AS1, AS2) from at least crankshaft-dependent performance characteristics stored in the respective actuator control unit (AS1, AS2).

15. A method for controlling an internal combustion engine having at least two cylinder heads, a single engine control unit (MS), and actuators (VA) for control of electromagnetic cylinder valves; said method comprising: assigning a separate actuator control unit (AS1, AS2) for controlling the actuators (VA) of the electromagnetic cylinder valves for each cylinder head of the internal combustion engine; and connecting the actuator control units (AS1, AS2) to the engine control unit (MS) via a data bus (DB).

16. A method according to claim 15, further comprising: in addition to the actuators (VA) for the electromagnetic cylinder valves control, providing each cylinder head for the internal combustion engine with additional actuators that are controlled by the actuator control unit (AS1, AS2) of the respective cylinder head.

17. A method according to the claim 16, wherein: the engine control unit (MS) controls the interplay between individual components for the internal combustion engine, and the respective actuator control units (AS1, AS2) control the functions of the actuators (VA) for the electromagnetic cylinder valves and the functions of the additional actuators of the respective cylinder heads; and the engine control unit (MS) provides preset values to the respective actuator control units (AS1, AS2) for controlling the functions of the actuators (VA) for the electromagnetic cylinder valve control and the functions of the additional actuators of the respective cylinder heads.

18. A method according to claim 15, further comprising: connecting engine sensors (S) for the internal combustion engine to the engine control unit (MS) and transmitting sensor data from the engine control unit (MS) via the data bus (DB) to the actuator control units (AS1, AS2).

19. A method according to claim 18, wherein an actuator control unit (AS1; AS2) can obtain sensor data from the engine control unit (MS) or from another actuator control unit (AS1; AS2); and further comprising: assigning emergency running properties to the actuator control units (AS1, AS2), which make it possible to continue to operate the internal combustion engine for a short period of time after malfunctions occur; and also directly connecting the engine sensors (S) of the internal combustion engine to the actuator control units (AS1, AS2) in order to provide the emergency running properties.

20. A method according to claim 19 further comprising: synchronizing sensor data made available to an actuator control unit (AS1, AS2) via the data bus (DB) and via a direct connection to the engine sensors (S); if at least one actuator for a respective electromagnetic cylinder valve control fails, suppressing the fuel supply to the affected cylinder with the aid of the associated actuator control unit (AS1, AS2); and, if a connection between a respective actuator control unit (AS1, AS2) and the engine control unit (MS) fails, obtaining, by the respective actuator control unit (AS1, AS2), preset values of the engine control unit (MS) for controlling the functions of the actuators (VA) for the electromagnetic cylinder valve control as well as the other actuators of the corresponding cylinder head from at least crankshaft-dependent performance characteristics stored in the respective actuator control unit (AS1, AS2).

* * * * *